US005176198A

United States Patent [19]

Frischknecht et al.

[11] Patent Number: 5,176,198

[45] Date of Patent: Jan. 5, 1993

[54] MOLTEN METAL FEED IN A STRIP CASTER

[75] Inventors: Bruno Frischknecht; Rudolf Roder, both of Gwatt, Switzerland

[73] Assignee: Lauener Engineering Ltd., Gwatt, Switzerland

[21] Appl. No.: 657,852

[22] Filed: Feb. 19, 1991

[30] Foreign Application Priority Data

Feb. 19, 1990 [CH] Switzerland ..... 00528/90

[51] Int. Cl.[5] ..... B22D 11/06; B22D 41/00

[52] U.S. Cl. ..... 164/480; 164/490; 164/136

[58] Field of Search ..... 164/430, 431, 432, 481, 164/490, 438, 440, 136

[56] References Cited

U.S. PATENT DOCUMENTS 2,348,178 5/1944 Merle ..... 164/480

2,639,490 5/1953 Brennan ..... 164/432

FOREIGN PATENT DOCUMENTS 186314 11/1963 Sweden ..... 164/428

*Primary Examiner*—Kuang Y. Lin

*Attorney, Agent, or Firm*—Bachman & LaPointe

[57] ABSTRACT

Molten metal (15), in particular molten aluminum or aluminum alloy, is fed to the adjustable roll gap (42,44) between two casting rolls (42,44) of the horizontal strip caster by means of a nozzle which is horizontally displaceable and vertically adjustable on a carriage. The feeding of the nozzle is interrupted to exchange or clean the latter and the carriage is removed from and returned to the region of the casting rolls. The metal feed from a stationary launder into a mobile launder and/or into a molten metal distribution trough of the nozzle is continued even during interruption of the casting. A stationary launder having an outflow in the region of the end face which can be closed by an adjustable plug is arranged above a mobile launder having a molten metal distribution trough for the nozzle which is isolated via an adjustable aperture, this mobile launder being arranged on a carriage, in a manner such as to be longitudinally displaceable or longitudinally displaceable and laterally swivellable. The outflow from the stationary launder always remains above the mobile launder when the latter is longitudinally displaced and/or swung laterally.

9 Claims, 4 Drawing Sheets

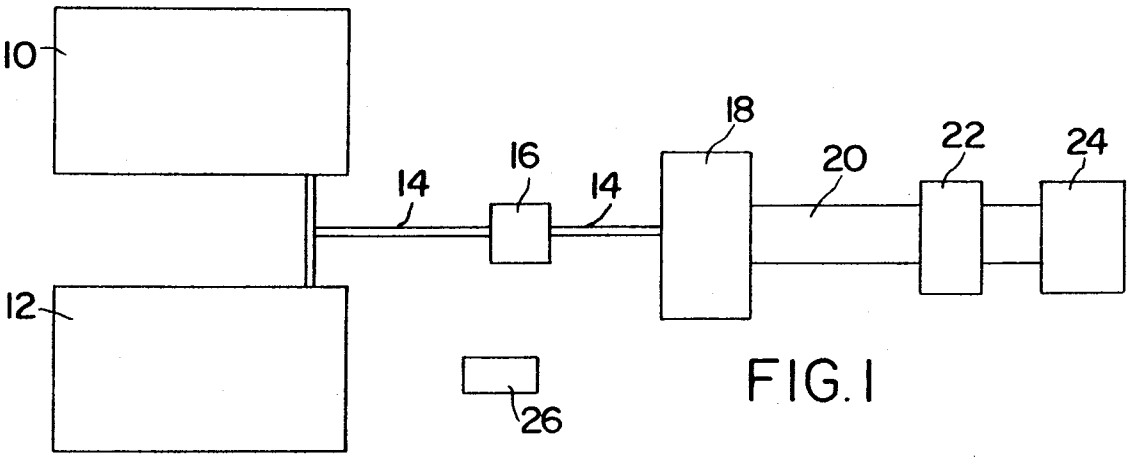
FIG. 1
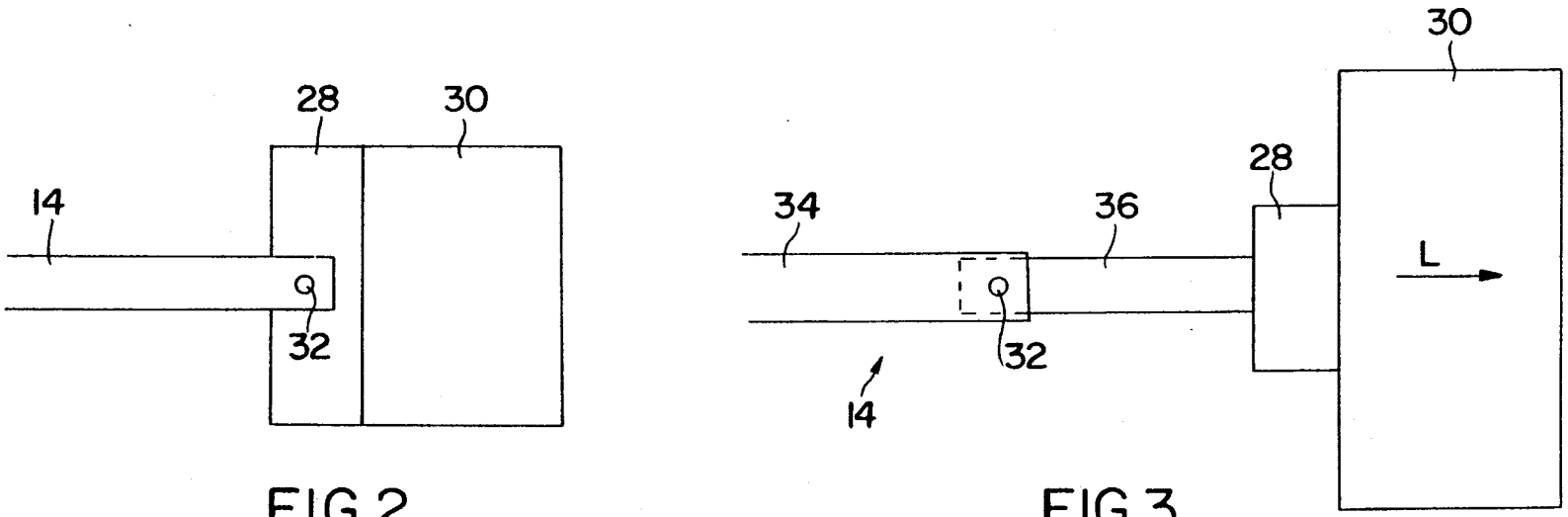
FIG. 3
FIG. 2

MOLTEN METAL FEED IN A STRIP CASTER

BACKGROUND OF THE INVENTION

The invention relates to a method for feeding molten metal, in particular molten aluminum or a molten aluminum alloy, by means of a nozzle which is horizontally displaceable and vertically adjustable on a carriage, into the adjustable roll gap of two casting rolls of a horizontal strip caster, the feeding of the nozzle being interrupted for the exchange or cleaning thereof, and the carriage being removed from and returned to the region of the casting rolls. The invention also relates to a strip caster for carrying out the method.

Known horizontal strip casters possess, in accordance with a first alternative embodiment, two casting rolls arranged one above the other (e.g. LAUENER Roll Caster), and in accordance with a second alternative embodiment two casting belts (e.g. HAZELETT) or caterpillar molds (e.g. LAUENER Block Caster) rotating one above the other, which are retained by a machine frame or are arranged in a housing. In the preceding section and in what follows, the machine components forming the roll gap are, in accordance with the preferred form of embodiment, referred to only as casting rolls. Above and in what follows, this term also analogously encompasses strip casters with rotating casting belts and caterpillar molds.

In the region of the roll gap or casting gap, a nozzle is situated in the working position between the two casting rolls and is generally fixed to the machine frame. A casting trough, also referred to as a molten metal distribution trough, fed by a casting launder system conducts liquid metal into the nozzle. Although this nozzle can be installed and removed together with its nozzle holder, accessibility is greatly impeded, particularly by a machine frame.

U.S. Pat. No. 4,577,672 (corresponding to French Patent 2,534,500) describes a nozzle unit which is independent of the remainder of the horizontal strip caster and permits precise positioning of the nozzle with reference to the casting gap. This nozzle unit is arranged on a nozzle beam, which is mounted on a carriage that can be moved in the casting direction by a drive. The nozzle can also be displaced in the vertical direction. The horizontal and vertical movements have a fine adjustment which permits exact positioning of the nozzle. This is particularly advantageous during a nozzle change or cleaning of the nozzle, since the nozzle can be removed from the region of the casting rolls for this purpose and repositioned precisely after the necessary work.

Although the solution according to U.S. Pat. No. 4,577,672 provides substantial advantages, it also contains some disadvantages. Before the nozzle is exchanged or cleaned, the casting launder has to be lifted or swivelled away laterally, and it is necessary for the molten metal it contains to be emptied as far as the holding furnace. During the exchange or cleaning of the nozzle, the lifted or swivelled away empty launder cools. Before the strip caster becomes operational again, it is necessary not only to position the nozzle and swing back the launder, but also to preheat the launder. The result is an interruption of work for a total of about 1-2 hours, which is of considerable importance, particularly when the exchange or cleaning operation is repeated one or more times.

SUMMARY OF THE INVENTION

The object of the present invention is to provide a method and an apparatus of the type referred to initially which, during horizontal strip casting, permit a change of nozzle or cleaning of the nozzle within a period of considerably less than one hour. This means in practice that a nozzle virtually always has to be exchanged for cleaning. It also means that the necessary free space for exchanging or cleaning the nozzle has to be created.

As regards the method, the object is achieved according to the invention, in that the metal feed from a stationary launder into a mobile launder and/or into a molten metal distribution trough of the nozzle is continued even during an interruption in casting. The specific embodiments and further developments of the invention will be discussed hereinbelow.

This means that, in the case of a nozzle which is to be exchanged or cleaned, the outflow of metal is interrupted before the nozzle is withdrawn. However, molten metal continues to be fed to the molten metal distribution trough and to a mobile casting launder connected thereto. This has the advantage, essential to the invention, that the launder does not cool down. After the nozzle has been exchanged or cleaned in situ, it can be repositioned and the casting operation can continue without further interruption. Instead of 1-2 hours, the interruption lasts only about 10 minutes, or a small fraction of the previously necessary expenditure of time.

The molten metal feed is preferably continued unchanged during an interruption of casting. As a result, the casting can be continued after the interruption with molten metal of virtually unchanged temperature.

In the event of a reduction in the quantity of molten metal fed in per unit of time, which is entirely possible in terms of control technology, the temperature of the molten metal must be expected to be too low when casting recommences.

During the interruption the metal level in the molten metal distribution trough and an assigned mobile launder rises continuously with the nozzle closed, until it preferably flows away through an overflow or through an outflow flap and is collected in a collection tank. From this collection tank, which is expediently insulated, the liquid metal can again be returned to the smelting or holding furnace. The overflow prevents all-round, uncontrolled overflowing of the molten metal distribution trough and of an assigned mobile launder.

A defective or blocked nozzle which is withdrawn from the roll space is replaced by a new nozzle of the same geometric dimensions or cleaned on the spot, though this latter expedient is only possible in exceptional cases in practice. The new or cleaned nozzle is reproducibly returned to exactly the same position. Apart from this unintentional disruption of the casting process, which briefly interrupts the casting operation, the nozzle may also be changed deliberately in the event of a program change which requires a different width and/or thickness of the cast strip. In this case, the nozzle is returned to a different position determined by program control.

Although the operations of retracting and/or repositioning of the nozzle could be carried out completely or partly by hand, for example by means of spindles actuated by a hand wheel, particularly for fine adjustment, the retraction and reproducible or precalculated positioning of the nozzle is preferably completely automated. In the case of a nozzle exchange associated with a program change the precalculated new positioning expediently entails a simultaneous, program controlled change of the roll gap, for example as described in EP-A1 0309394.

In addition to any necessary change in height, the mobile launder is displaced in the longitudinal direction or is slightly displaced in its longitudinal direction and swung laterally, for example through about 90°. In the case of lateral swinging, the axis of rotation lies in the region of the outflow from the stationary launder, so that the liquid molten metal fed in without interruption does not flow adjacent to it. During retraction, the mobile launder is first retracted slightly and then swung, while for repositioning it is first swung and then pushed slightly forward.

In a modern strip casting plant, the following parameters can preferably be changed individually or simultaneously under program control, even during operation if necessary:

The quantity of molten metal fed per unit of time, using floats or contact-free sensors to measure the level.

The position of the nozzle via horizontal and vertical play-free guides of the carriage, using linear length measuring devices (linear transducers) or adjustable stops.

The rollgap between the casting rolls, for example according to the abovementioned EP-A1 0309394.

The width of the cast metal strip, by moving lateral restrictions.

As regards the apparatus for carrying out the method, the object is achieved according to the invention in that the strip caster comprises a stationary launder with an outflow which can be closed by an adjustable plug and is situated in the region of the end face, and a mobile launder arranged below the outflow on a carriage so as to be capable of longitudinal displacement, or longitudinal displacement and lateral swivelling, and having a molten metal distribution trough for the nozzle which is separated by an adjustable aperture, the outflow from the stationary launder always remaining above the mobile launder in the event of longitudinal displacement and/or lateral swivelling of the latter.

This system of launders situated one above the other ensures that the liquid molten metal can always flow into the mobile launder with the molten metal distribution trough, even after the retraction of the nozzle, thus preventing cooling-down.

In order to measure the level of the metal, measuring instruments, preferably connected to a computer, are arranged in the stationary launder, the mobile launder and the molten metal distribution trough, and permit the adjustment of the plug of the stationary launder and the aperture from the mobile launder to the molten metal distribution trough under program control. In the event of a change in the quantity of molten metal fed in per unit of time, which is also possible during operation, the plug and the aperture are set to the programmed positions and the flow of metal is monitored by continuous or periodic level measurements.

The carriage for the longitudinally displaceable and vertically adjustable nozzle, which nozzle is not per se a subject of the invention, is guided on a support or carrier which possesses play-free vertical and horizontal guides. For the reproducible or precalculated new positioning of the nozzle, two exemplary embodiments are preferably provided:

The arrangement of linear length measuring devices with associated control circuits and automatic signalling devices.

The provision of stops, which can be adjusted manually or under program control, to limit the hydraulic, pneumatic or mechanical displacement of the carriage.

BRIEF DESCRIPTION OF THE DRAWINGS

The invention is explained in detail with reference to illustrative embodiments shown in the drawings, diagrammatically:

FIG. 1 shows a layout of a plant for horizontal strip casting,

FIG. 2 shows a plan view of a casting nozzle with the molten metal feed according to the known state of the art, FIG. 3 shows a plan view of a casting nozzle with the molten metal feed according to the invention.

DETAILED DESCRIPTION

Figure 4:
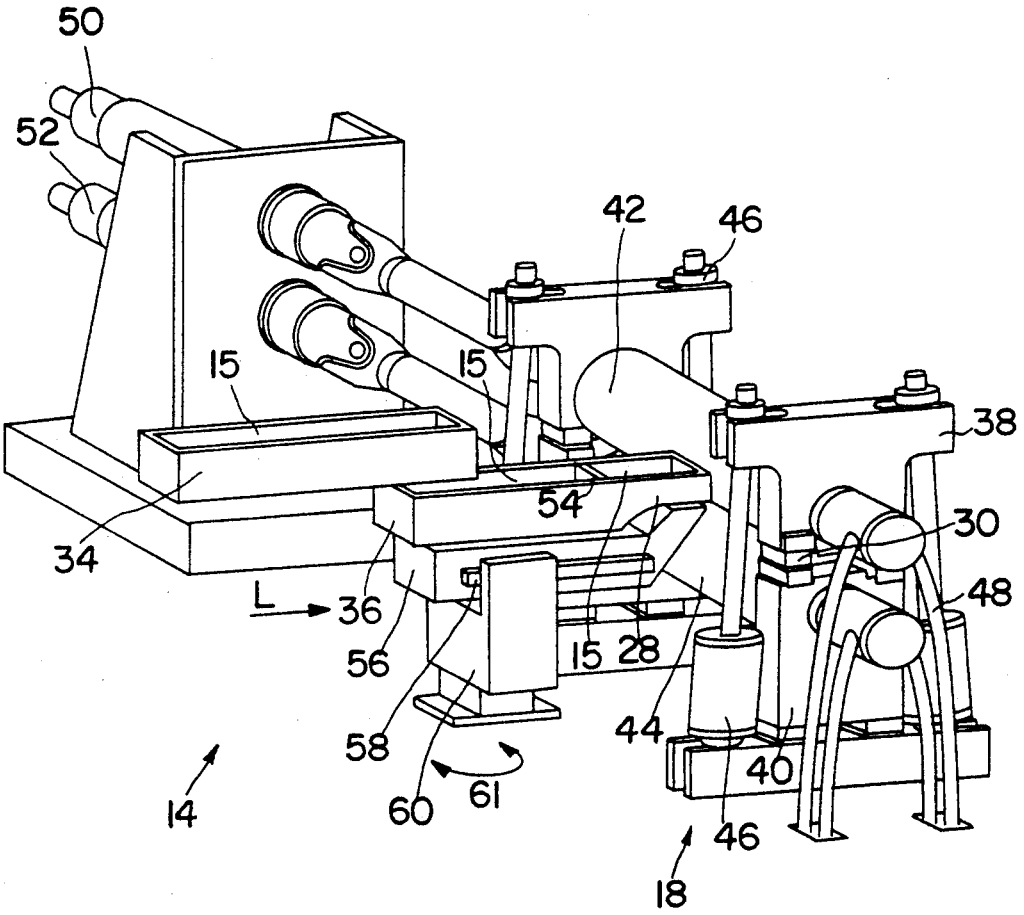
FIG. 4 shows a perspective view of a metal feed and a strip caster in the working position.

The strip casting installation which is shown in principle in FIG. 1 indicates the essential components of the installation and the metal strip produced. The tiltable furnaces 10, 12 can be optionally used as casting or heat-retention furnaces, the latter also being referred to for short as a holding furnace, but one of the furnaces 10, 12 is always the casting furnace and the other the heat-retention furnace.

The liquid molten metal flows from the heat-retention fur]ace 10 or 12 into a casting launder system 14 which leads first to a filter system 16 and then to the horizontal strip caster 18, also referred to simply as a caster. The filter system 16, comprising at least one filter, serves to remove gaseous components and/or solid particles. The strip caster 18 encompasses two casting belts or caterpillar molds, rotating one above the other, but preferably two casting rolls arranged one above the other.

The cast metal strip 20 is, in the present case, guided over a dancer roll (not shown) through a shearing unit 22 with a strip guide to a coiler 24. Particularly in the case of a strip caster with rotating casting belts or caterpillar molds, the cast metal strip 20 is hot-rolled before entering the shearing unit 22.

Finally, a control console 26 with a processor is indicated, this recording the measurements for all sections of the installation, comparing the actual values with the target values, controlling the adjusting members of sections of the installation, and storing, analysing and displaying data.

FIG. 2 illustrates the end face of the casting launder system 14 in the direction of the strip caster 18 (FIG. 1), a molten metal distribution trough 28 and a nozzle 30 in the working position, in accordance with the known conventional state of the art. In the working position which is shown in FIG. 2, the liquid molten metal flows through a controllably closeable outflow 32 into the molten metal distribution trough 28. The aperture between the molten metal distribution trough 28 and the nozzle 30 (not shown) is likewise closeable.

If the casting operation has to be interrupted because of a defective or blocked nozzle 30, this can be moved out of the region of the casting rolls, for example in accordance with U.S. Pat. No. 4,577,672. To do this, the end piece of the casting launder system 14 must be lifted and/or swung to the side, the liquid molten metal being emptied.

FIG. 3 shows the components of the present invention, corresponding to FIG. 2, the nozzle 30 again being in the working position. The end of the conventional casting launder system 14 towards the nozzle 30 is not designed to be either liftable or capable of being swung to the side, and is referred to as the stationary launder 34. Below this stationary launder 34 is a mobile launder 36 which can be moved back with the nozzle 30 in the longitudinal direction L. The outflow 32 from the stationary launder 34 always remains above the mobile launder 36. The latter, in respect of cross-section, is of equal size to or, as in the present illustrative embodiment, somewhat smaller than the stationary launder 34. It should be noted that the molten metal treatment trough 28, also referred to as a "head box", and the mobile launder 36 have the smallest volume possible.

Arranged between the mobile launder 36 and the molten metal distribution trough 28 is a controllably closeable aperture which is described later in detail.

The perspective illustration according to FIG. 4 shows a strip caster 18 with an incoming casting launder system 14 which is filled with liquid molten metal 15. In the example shown, the strip caster 18 is designed without a housing, as is described in detail, for example, in U.S. Pat. No. 4,567,933. The retaining frames 38, 40 for the casting rolls 42, 44 are connected to each other via a pre-tensioning device 46. The casting rolls 42, 44 are internally cooled, the coolant medium being fed in and removed via hoses 48. The casting rolls 42, 44 are also driven by individual motors 50, 52, which are synchronized.

The mobile launder 36, which is arranged below the stationary launder 34 and is displaceable in the direction of flow of the molten metal 15 or in the longitudinal direction L, also encompasses the molten metal distribution trough 28 of the same cross-section, which is isolated by a partition wall 54 provided with a controllably closeable aperture, which is not shown.

The mobile launder 36 with the molten metal distribution trough 28 is supported on a carriage 56 which possesses horizontal, lateral guide strips 58 in the longitudinal direction L. These are displaceable without play in corresponding grooves of a support 60, which are not shown.

The support 60 is adjustable in respect of height in the vertical direction, which is not apparent from FIG. 4. This support 60 is also of relatively small horizontal cross-section particularly in the longitudinal direction L, so that the maximum possible free space is obtained in the region of the casting rolls 42, 44 when the mobile launder 36 is retracted. This is particularly important if the rolls are externally cooled.

The support 60 can be swung laterally by means of a mechanism of a construction known per se, which is not shown but is indicated by an arrow 61. The mobile launder 36 with the molten metal distribution trough 28 can be swung through any desired angle, after the mobile launder 36 has been slightly retracted in the longitudinal direction L in order to maintain the necessary free space, or before it is pushed slightly forward again.

Figure 5:
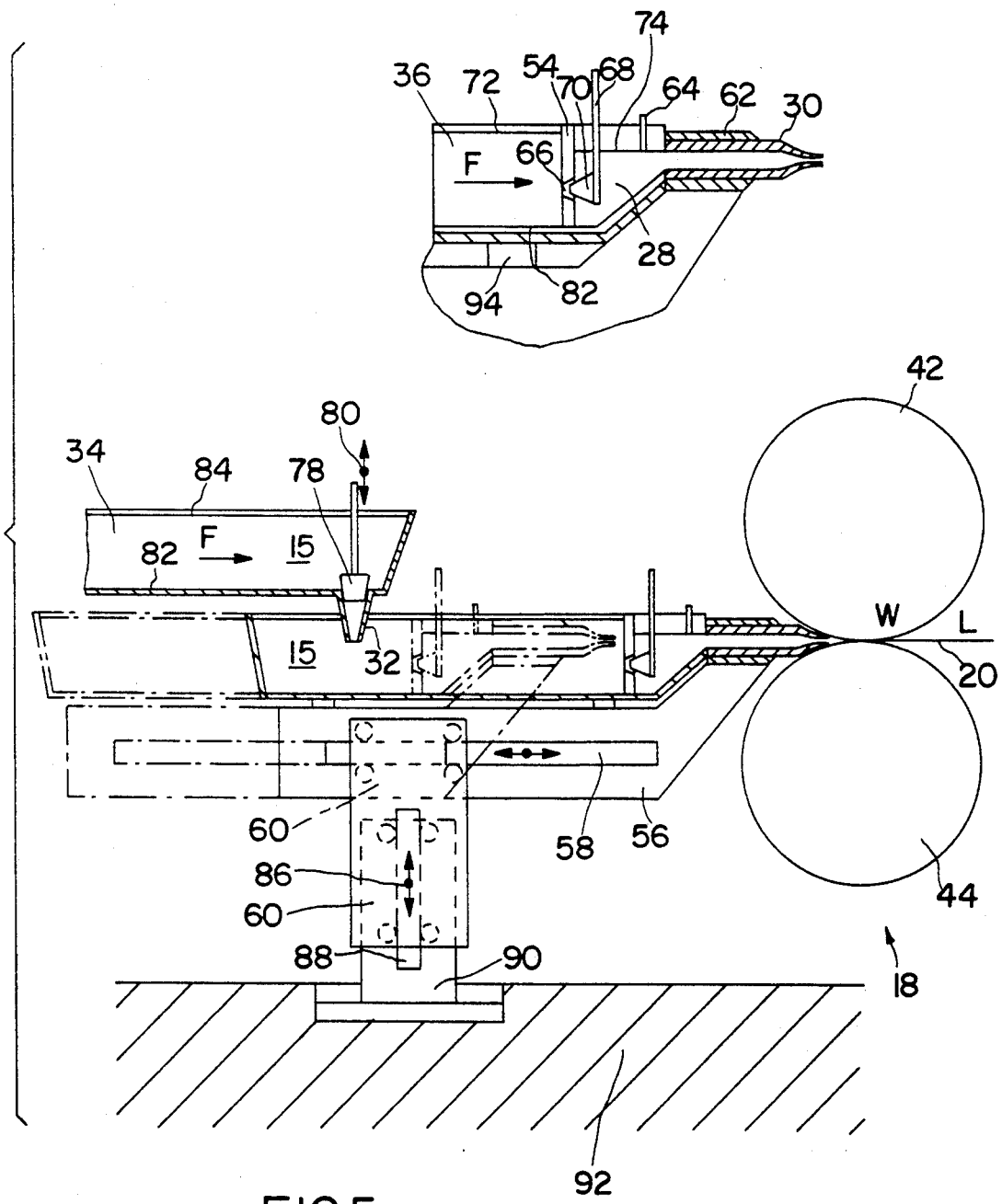
FIG. 5 shows a partially sectioned part view of a strip caster in the working position.

FIG. 5 shows only the casting rolls 42,44 of the actual strip caster 18 (FIGS. 1, 2), which form a roll gap w. The nozzle 30, which can be removed from the molten metal distribution trough 28, is introduced into the space between the casting rolls 42, 44, that is to say in the working position, and is supported by a nozzle support 62.

The molten metal 15 passed into the roll gap w can be interrupted by lowering a slide 64 if the nozzle 30 has to be retracted.

The rearmost part of the mobile launder 36 in the direction of flow F of the molten metal 15 forms the molten metal distribution trough 28, which is isolated by a partition wall 54 having an aperture 66. This aperture can be controllably closed by means of a flap 68 with a truncated cone 70 at its end. The swinging movement of the flap 68 is indicated by an arrow 76. The metal level 72 in the mobile launder 36 is therefore higher than the metal level 74 in the molten metal distribution trough 28.

The liquid molten metal 15 passing through the outflow 32 from the stationary launder 34 into the mobile launder 36 is regulated by a plug 78 which is displaceable in the vertical direction in the direction of the arrow 80.

Both the stationary launder 34 and the mobile launder 36 with the molten metal distribution trough 28 are lined with a refractory insulating layer 82.

The metal level 84 in the stationary launder 34 is monitored, like the metal level 72, 74 in the mobile launder 36 and the molten metal distribution trough 28, by floats or contact-free sensors which are not shown for the sake of simplicity. Both methods are known per se. The signals generated are proportional to the vertical position of the float or to the distance between sensor and metal surface. These signals are processed and transmitted to a processor or computer, where the actuation of adjusting members is triggered, which adjusting members control the metal feed in accordance with the measured metal levels 72, 74, 84. The adjusting members are, for example, the plug 78 and the flap 68.

The broken lines indicate the position of the retracted nozzle 30 with the mobile launder 36 and the carriage 56.

For precise positioning of the nozzle 30, a vertical adjustment in the direction of the arrow 86 is necessary in addition to the horizontal adjustment. The support 60 of the carriage 56 can be displaced via a vertical guide 88. In modern installations, of course, both the horizontal and vertical movement are under program control, for example with the use of linear transducers or adjustable stops of a known construction, the possibility of manual fine adjustment 1— not shown in FIG. 5 1+ also existing.

The support 60 is carried by a pedestal 90, which is fixedly anchored in the floor 92.

The mobile launder 36 has an outflow 94 for the removal of the liquid molten metal after the end of the casting operation, which can last up to about 10 days.

Figure 6:
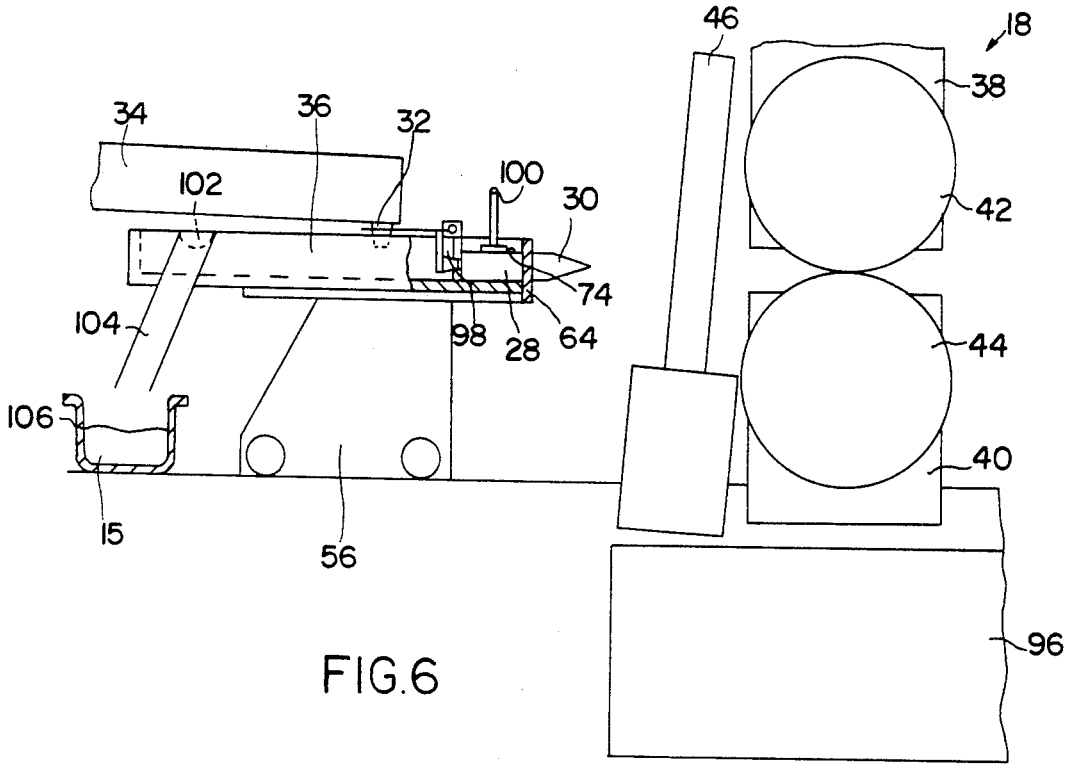
FIG. 6 shows a partially sectioned view of a strip caster with the nozzle retracted.

FIG. 6 shows a strip caster 18 arranged on a base plate 96, the retaining frames 38, 40, the casting rolls 42, 44 and the pre-tensioning device 46 of this strip caster 18 being indicated.

The mobile launder 36 with the molten metal distribution trough 28 and the nozzle 30 detachably attached thereto are retracted, and the slide 64 is closed.

The mobile launder 36 and the molten metal distribution trough 28 are separated by a pivotable flap 98, which forms an adjustable aperture. A float 100 monitoring the metal level 74 is also indicated in the molten metal distribution trough 28.

In the position of the nozzle 30 shown in FIG. 6, the casting operation is interrupted. The liquid molten metal 15 is, however, fed via the stationary launder 34 in the same quantity per unit of time. The metal levels 72, 74 in the mobile launder 36 and the molten metal distribution trough rise because the nozzle is sealed by the slide 64. An overflow 102 prevents the molten metal 15 from flowing uncontrollably over the edge of the mobile launder 36 and of the molten metal distribution trough 28. A pipe 104 passes the outflowing molten metal 15 into a collecting tank 106. An overflow is likewise present, of course, in the illustrative embodiment according to FIG. 5, but this is shown only in FIG. 6 for reasons of clarity.

Figure 7:
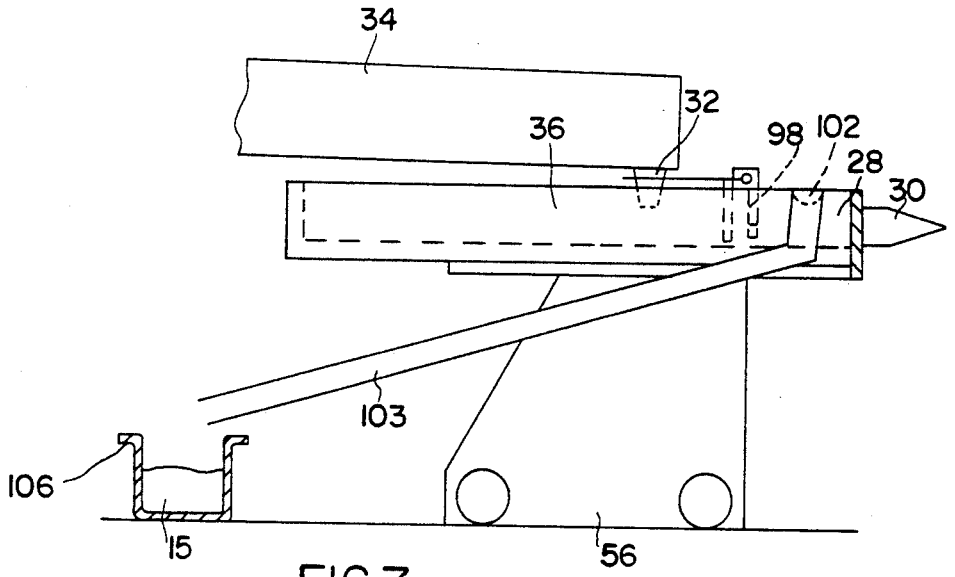
FIG. 7 shows an alternative embodiment of the overflow in FIG. 6.

FIG. 7 substantially corresponds to FIG. 6, but the overflow 102 is arranged in the region of the molten metal distribution trough 28, as is preferentially the case. The overflowing metal 15 flows via a launder 103 into an insulated collecting tank 106, which can also be of closed design.

We claim:

1. The method which comprises: feeding molden metal by means of a nozzle which is horizontally displaceable and vertically adjustable on a carriage into an adjustable roll gap of two casting rolls of a horizontal strip caster; interrupting the feeding of the nozzle for at least one of the exchange and cleaning thereof; removing the carriage and returning the carriage to the region of the casting rolls; including the step of feeding the metal from a stationary launder into a mobile launder having a molten metal distribution trough connected thereto communicating with the nozzle; and continuing said feeding even during an interruption in casting.

2. Method according to claim 1 wherein the molten metal feed is continued at an unchanged rate of flow during an interruption of casting.

3. Method according to claim 1 wherein during an interruption in casting the metal level rises in at least one of the mobile launder and the molten metal distribution trough and including the step of flowing away the molten metal from at least one of the mobile launder and the molten metal distribution trough through at least one of an overflow and an outlet flap.

4. Method according to claim 3 including the step of flowing away the molten metal into at least one of a launder and a pipe and collecting said molten metal in a collection tank.

5. Method according to claim 1 wherein after interruption in feeding returning the nozzle under program control to the same position.

6. Method according to claim 5 wherein the nozzle is returned together with at least one of (a) a change of the roll gap of the casting rolls and (b) a change of the width of the metal strip formed by said horizontal strip caster.

7. Method according to claim 1 including the step of modifying under program control without interruption in casting at least one of the parameters (a) the quantity of molten metal fed in, (b) the roll gap between the casting rolls, and (c) the width of the metal strip formed by said horizontal strip caster.

8. Method according to claim 1 including the step of displacing the mobile launder in its longitudinal direction.

9. Method according to claim 1 including the step of displacing the mobile launder slightly in its longitudinal direction and swivelling same laterally, the vertical axis of rotation lying in the region of the outflow from the stationary launder.

* * * * *